United States Patent [19]

Okamoto et al.

[11] Patent Number: 4,692,666

[45] Date of Patent: Sep. 8, 1987

[54] GAS-DISCHARGE DISPLAY DEVICE

[75] Inventors: Yukio Okamoto, Sagamihara; Shinichi Shinada, Kokubunji, both of Japan

[73] Assignee: Hitachi, Ltd., Tokyo, Japan

[21] Appl. No.: 684,298

[22] Filed: Dec. 20, 1984

[51] Int. Cl.[4] ..... G09G 3/10

[52] U.S. Cl. ..... 315/169.4; 315/169.2; 340/776

[58] Field of Search ..... 315/169.4, 169.2; 313/584, 586; 340/776

[56] References Cited

U.S. PATENT DOCUMENTS

| | | | |
|---|---|---|---|
| 3,885,195 | 5/1975 | Amano | 315/169.4 |
| 4,140,945 | 2/1979 | Trogdon | 340/776 |
| 4,333,040 | 6/1982 | Okamoto et al. | 315/169.2 |
| 4,414,490 | 11/1983 | Harvey | 315/169.2 X |
| 4,562,434 | 12/1985 | Amano | 315/169.4 X |

FOREIGN PATENT DOCUMENTS

| | | | |
|---|---|---|---|
| 0054618 | 6/1982 | European Pat. Off. | 315/169.4 |

OTHER PUBLICATIONS

Amano et al., "A New dc PDP with Low Voltage Drive and High Resolution", Proceedings of the SID, vol. 23/3, pp. 169–174, 1982.

*Primary Examiner*—David K. Moore

*Attorney, Agent, or Firm*—Antonelli, Terry & Wands

[57] ABSTRACT

In a gas-discharge display device, a plurality of parallel cathodes connected to cathode terminals ($K\Phi_1$ to $K\Phi_4$) by multiphase connection are disposed in equally spaced apart relation on one surface of a substrate, while a plurality of parallel and equally spaced-apart anodes are disposed on the rear surface of a face plate in a relation crossing with the cathodes, and the fact plate is superposed on the substrate through barrier ribs defining a discharge space. In the display device, time-serial multiphase pulse voltage trains are applied to the individual cathodes respectively, while a train of pulses of large width corresponding to display information is applied to each of the anodes in a relation superposed on a train of pulses of small width used for initiation of an auxiliary discharge.

6 Claims, 5 Drawing Figures

GAS-DISCHARGE DISPLAY DEVICE

This invention relates to a gas-discharge display device, and more particularly to a high-resolution flat display device utilizing gas discharge for displaying characters, patterns or the like. A high-resolution flat display device utilizing gas discharge for displaying characters, patterns, or the like is already commonly known from the disclosure of, for example, a paper entitled "A NEW dc PDP WITH LOW VOLTAGE DRIVE AND HIGH RESOLUTION", Amano et al, Proceedings of the SID, Vol. 23/3, 1982, pp. 169–174. This known device has a structure as schematically shown in FIG. 1. Referring to FIG. 1, a plurality of trigger electrodes 20 are disposed on one surface of a substrate 10 and a plurality of cathodes 40 arrayed in the same direction as the extending direction of the trigger electrodes 20 and a plurality of barrier ribs 50 arrayed in a direction perpendicular to the extending direction of the cathodes 40 are disposed above the one surface of the substrate 10 through a dielectric layer 30. On the other hand, a plurality of anodes 70 are disposed on the rear surface of a face plate 60 and in a direction perpendicular to the extending direction of the cathodes 40. The face plate 60 is superposed on the substrate 10 to constitute a panel. In the panel, the cathodes 40 are connected to respective terminals $K\Phi_1$, $K\Phi_2$, $K\Phi_3$ and $K\Phi_4$ through multiphase connection 41, and the trigger electrodes 20 are connected to respective terminals $TR_1$, $TR_2$, $TR_3$ and $TR_N$ through leads 21. This display device is operated such that a pulse voltage is applied between a selected one of the cathodes 40 and a selected one of the trigger electrodes 20 to initiate an auxiliary discharge, and the charged particles or the like generated as a result of the auxiliary discharge are utilized, by applying a pulse voltage between the cathode 40 and a selected one of the anodes 70, to provide a display discharge for the purpose of information display. The above-mentioned known display device has, however, been disadvantageous from the aspects of cost and reliability in the following points:

(1) As many as $2\sqrt{n}$ drive circuits (and terminals) are required for the trigger electrodes 20 and cathodes 40 when the number of the cathodes is n.

(2) The necessity for provision of the trigger electrodes 20 and dielectric layer 30 leads to the complexity of the panel structure and drive circuit arrangement.

It is therefore an object of the present invention to provide a novel and improved, high-resolution gas-discharge type display device which solves the prior art problems pointed out above.

According to one aspect of the present invention, the display device is constructed such that a plurality of parallel cathodes connected to terminals through multiphase connection are disposed in equally spaced relation on one surface of a substrate, while, a plurality of parallel and equally spaced-apart anodes are disposed on the rear surface of a face plate in a crossing relation with the cathodes, and the face plate is superposed on the substrate through barrier ribs defining a discharge space. In the display device of the present invention, time-serial multiphase pulse voltage trains are supplied to the individual cathodes, while a train of pulses of large width representing display information superposed on a train of pulses of small width used for initiation of an auxiliary discharge are supplied to each of the anodes. The present invention is therefore advantageous over the prior art device in the function of self-scanning is exhibited for displaying necessary information.

The present invention will be apparent from the following detailed description taken in conjunction with the accompanying drawings, in which.

Figure 1:
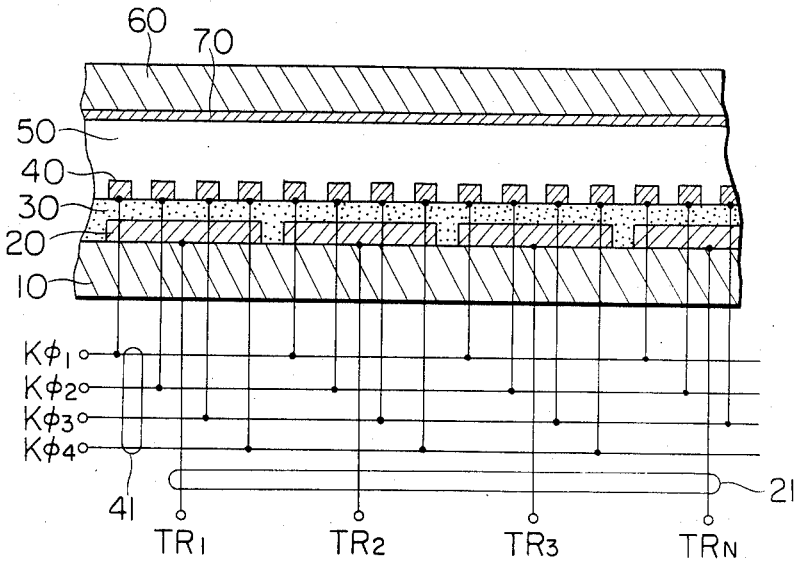
FIG. 1 PRIOR ART
FIG. 1 is a schematic sectional view showing the structure of a prior art display device.
Figure 2:
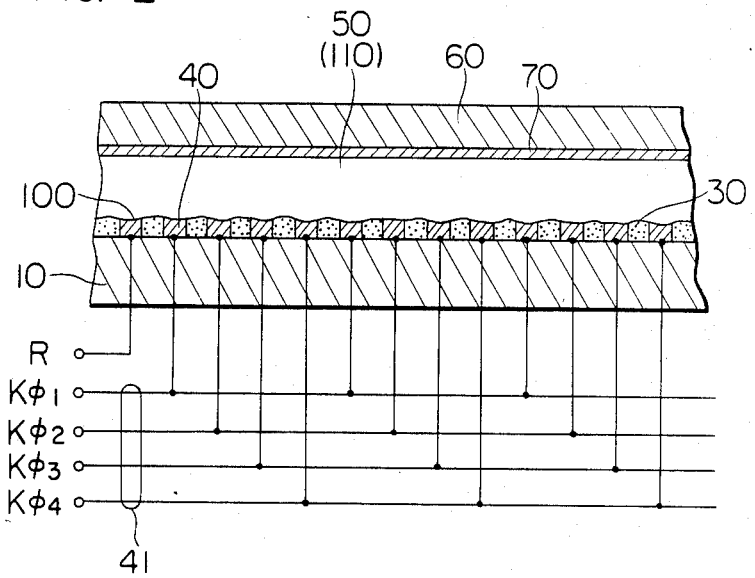
FIG. 2 is a schematic sectional view showing the structure of an embodiment of the display device according to the present invention.
Figure 3:
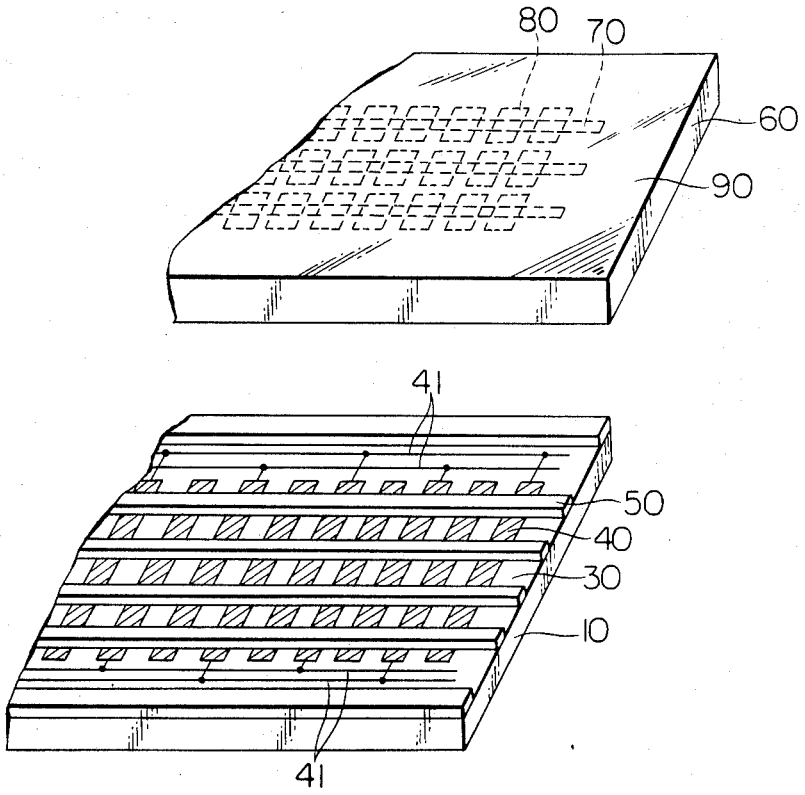
FIG. 3 is a exploded perspective view of the display device shown in FIG. 2.
Figure 4:
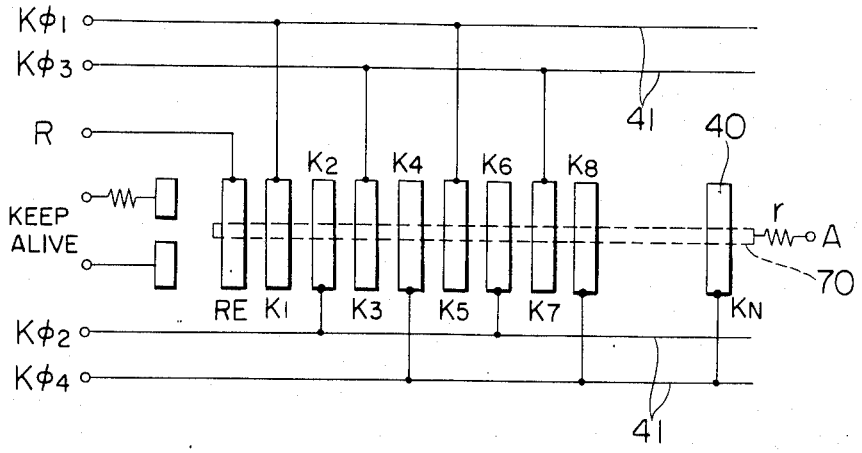
FIG. 4 is a diagram showing an electrode connection in the device of the present invention.
Figure 5:
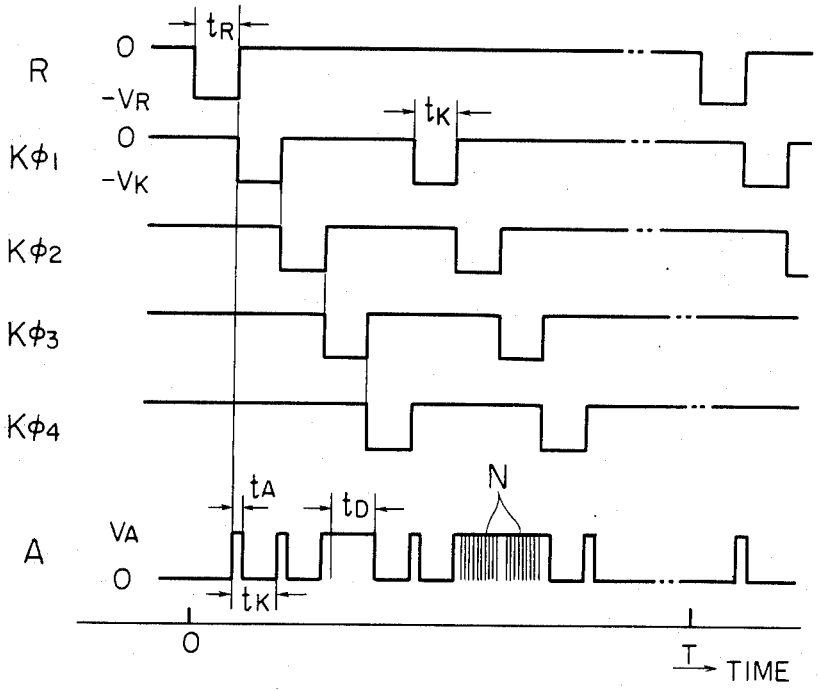
FIG. 5 shows driving voltage waveforms in the circuit shown in FIG. 4.

A preferred embodiment of the display device according to the present invention will now be described with reference to FIGS. 2–5 in which FIG. 2 is a schematic sectional view, FIG. 3 is a schematic, exploded perspective view, FIG. 4 is an electrode connection diagram, and FIG. 5 shows driving voltage waveforms.

Referring to FIGS. 2 and 3, a plurality of cathodes 40 of Ni or like material, which are parallel to and equally spaced apart from each other, are formed on one surface of a substrate 10 of glass or like material by the technique of thick-film or thin-film deposition, by plating or the like. Preferably, the line width of the cathodes 40 is selected to be about 0.03 to 0.1 mm, and the pitch of the cathodes 40 is selected to be about 0.1 to 0.5 mm. Multiphase connection, for example, four-phase connection 41 is formed on the substrate 10 using the multilayer connection technique or the like, and the cathodes 40 are connected through the four-phase connection 41 to respective terminals $K\Phi_1$, $K\Phi_2$, $K\Phi_3$, and $K\Phi_4$ provided at one end of the substrate 10. The multiphase connection may be made at the exterior of the substrate 10. For the purpose of more completely preventing shorting between the cathodes 40, a dielectric layer 30 provided by printing and firing a dielectric material such as a glass paste may be formed to fill the space between the cathodes 40. (In such a case, the height of the dielectric layer 30 is preferably larger than that of the cathodes 40 but smaller than that of barrier ribs 50 described next.) Then, a plurality of barrier ribs 50, which are parallel to each other and extend in a direction crossing with the extending direction of the cathodes 40, are provided by printing and firing a dielectric material such as a glass paste. The barrier ribs 50 may be formed of glass fibers. Preferably, the width of the barrier ribs 50 is about 0.05 to 0.1 mm, and the height thereof is about 0.05 to 0.5 mm.

On the other hand, a plurality of anodes 70 of Ni or transparent, conductive material such as indium oxide, which are parallel to and equally spaced apart from each other and whose pitch is the same as that of the barrier ribs 50, are provided on the rear surface of a transparent face plate 60 of material such as glass. For the purpose of improving the contrast of display, a black film 90 is provided on the portions of the surface of the face plate 60, except the display part 80, by printing and firing a glass paste or the like of basically black color. When a color display is desired, phosphors (not shown) are coated on the display part 80 of the face plate 60. Further, as occasion demands, the front surface of the face plate 60 may be processed to provide a total reflection surface so as to prevent reduction of visibility of display due to reflection of external light incident thereupon.

The substrate 10 and face plate 60 having the aforementioned electrodes and the like formed thereon are superposed such that the cathodes 40 and anodes 70 cross each other and the anodes 70 are located between the barrier ribs 50. After sealing the resultant panel gas-tight at the periphery thereof so that it can withstand a high vacuum, the panel is evacuated to a high vacuum under heat, and a rare gas mixture containing essentially Ne-Ar, Ne-Xe, He-Xe, Xe or the like at 10 to 600 Torr is enclosed in a discharge space 110 formed by the barrier ribs 50. A small amount of Hg may be mixed in the rare gas for the purpose of reducing electrode sputtering.

How to drive the above panel will be described with reference to FIGS. 4 and 5. An outermost one of the plural cathodes 40 is selected as a reset electrode RE connected to a reset terminal R. The remaining cathodes 40 ($K_1$, $K_2$, - - -, $K_N$) are divided into groups each of which is composed of, for example, four cathodes, and the cathodes 40 in each group are periodically connected through the four-phase connection 41 to the respective terminals $K\Phi_1$ to $K\Phi_4$. A pair of keep-alive electrodes are disposed adjacent to the reset electrode RE to ensure reliable operation of the electrode RE. On the other hand, a current limiting resistor r is connected at one end thereof in series with each of the plurality of the anodes 70 and at the other end thereof to each of anode terminals A.

Pulse voltages having waveforms such as shown in FIG. 5 are applied to the various terminals shown in FIG. 4. That is, a reset pulse voltage having a pulse width $t_R$ (10 to 300 $\mu$s), a period T and an amplitude $-V_R$ is applied to the reset terminal R. Cathode pulse voltage having a pulse width $t_K$ (10 to 300 $\mu$s) and an amplitude $-V_K$ are applied in a time-serial four-phase fashion to the respective cathode terminals $K\Phi_1$ to $K\Phi_4$ as shown in FIG. 5. On the other hand, a continuous anode pulse voltage having a pulse width $t_A$ (0.5 to 20 $\mu$s), a period $t_K$ and an amplitude $V_A$ is applied to each of the anode terminals A. In response to the application of such pulse voltages to the associated terminals, a reset discharge occurred initially across the reset electrode RE and the associated anode causes successive discharges from the cathodes $K_1$, $K_2$, - - - $K_N$ with the anode acting as the common electrode. This phenomenon is the so-called self-scanning, and the display device of the present invention possesses this self-scanning function.

For the purpose of information display, a display pulse voltage having a pulse width $t_D$ and an amplitude $V_A$ as shown in FIG. 5 is superposed on the anode pulse voltage applied to each of the anode terminals A. The display pulse may be in the form of a pulse train N of pulses of small width as shown.

It will be understood from the foregoing description that the present invention can reduce the cost and improve the reliability by virtue of the following advantages:

(1) The panel has a simplest structure.

(2) The provision of the self-scanning function can greatly reduce the required number of drive circuits (and terminals) as compared with the prior art device. In the present invention, the required total number of drive circuits (and terminals) is reduced to one reset drive circuit, P cathode drive circuits (where P indicates P-phase connection and is 4 in the case of four phases), and a drive circuit for each of anodes.

We claim:

1. A gas-discharge device comprising:

a plurality of cathodes disposed on a substrate to extend in one direction in a relation parallel to and equally spaced apart from each other, said cathodes being connected to respective cathode terminals by multiphase connection;

a plurality of barrier ribs disposed above said cathodes to extend in a direction crossing with the extending direction of said cathodes and in a relation parallel to and equally spaced apart from each other;

a plurality of anodes disposed in a relation parallel to and equally spaced apart from each other so as to be located between said barrier ribs, said anodes being connected to respective anode terminals;

a face plate disposed on said anodes, said face plate and said substrate defining therebetween a space which is filled with a gas and maintained gas-tight; and means for applying time-serial multiphase pulse voltages to said respective cathode terminals and for applying a pulse voltage including pulses of small width occurring at a timing corresponding to that of said multiphase pulse voltages and pulses of large width representing display information superposed on said small width pulses to each of said anode terminals.

2. A gas-discharge display device as claimed in claim 1, wherein a dielectric layer is provided to fill the gap between said cathodes.

3. A gas-discharge display device as claimed in claim 1, wherein a black film is provided on said face plate except the display part so as to improve the contrast of display.

4. A gas-discharge display device as claimed in claim 1, wherein phosphors for color display are coated on the display part of said face plate.

5. A gas-discharge display device as claimed in claim 1, wherein a total reflection film for reflecting incident external light is provided on the surface of said face plate.

6. A gas-discharge display device as claimed in claim 1, wherein each of the pulses of large width included in said pulse voltage indicative of information to be displayed is in the form of a pulse train of pulses of small width.

* * * * *